US009051806B2

(12) United States Patent
Lenz et al.

(10) Patent No.: US 9,051,806 B2
(45) Date of Patent: Jun. 9, 2015

(54) SEPARATOR FOR MECHANICALLY SEPARATING AN ACTUATOR AND AN OPERATOR

(75) Inventors: Norbert Lenz, Celle (DE); Klaus Biester, Celle (DE)

(73) Assignee: OneSubsea IP UK Limited, London (GB)

( * ) Notice: Subject to any disclaimer, the term of this patent is extended or adjusted under 35 U.S.C. 154(b) by 0 days.

(21) Appl. No.: 14/125,049

(22) PCT Filed: Jun. 10, 2011

(86) PCT No.: PCT/EP2011/002860

§ 371 (c)(1),
(2), (4) Date: Mar. 11, 2014

(87) PCT Pub. No.: WO2012/167809

PCT Pub. Date: Dec. 13, 2012

(65) Prior Publication Data

US 2014/0191144 A1 Jul. 10, 2014

(51) Int. Cl.

| | |
|---|---|
| ***B23P 19/04*** | (2006.01) |
| ***E21B 34/02*** | (2006.01) |
| ***E21B 33/064*** | (2006.01) |
| ***E21B 34/04*** | (2006.01) |
| ***E21B 41/04*** | (2006.01) |

(52) U.S. Cl.

CPC ..... *E21B 34/02* (2013.01); *E21B 33/064* (2013.01); *E21B 34/04* (2013.01); *E21B 41/04* (2013.01)

(58) Field of Classification Search

USPC ..... 29/252, 244

See application file for complete search history.

(56) References Cited

U.S. PATENT DOCUMENTS 1,903,190 A * 3/1933 Neldner ..... 70/175
1,945,428 A * 1/1934 Featherstone ..... 70/179
4,045,983 A * 9/1977 Hughes ..... 70/404
5,060,690 A * 10/1991 Sparrow ..... 137/540

FOREIGN PATENT DOCUMENTS

DE 20213391 U1 1/2004
WO 2008125136 10/2008

OTHER PUBLICATIONS

International Search Report and Written Opinion dated Jun. 4, 2012 for PCT Application No. PCT/EP2011/002860 filed Jun. 10, 2011.

* cited by examiner

*Primary Examiner* — Lee D Wilson
*Assistant Examiner* — Shantese McDonald
(74) *Attorney, Agent, or Firm* — Chamberlain Hrdlicka

(57) ABSTRACT

The separator serves to mechanically separate an actuator and an operating mechanism, such as a choke, a valve, a blow-out preventer or the like, which is displaceable by said actuator, for use especially in the field of oil or natural gas production. The separator is adapted to be arranged between the actuator and the operating mechanism and comprises at least a first component associated with the actuator and a second component associated with the operating mechanism. These first and second components are displaceable relative to one another by means of at least one application part, which is connected to the first or second component, between an engagement position and a release position. The application part is adapted to be brought into releasable engagement with a displacement part which is suitable for handling by a user. This allows the actuator and the operating mechanism to be easily separated by the respective separator, without said separator leading to any structural modifications or enlargements of the actuator and/or operating mechanism. In addition, the separator is easily operable especially by an external user, and a predetermined displacement of the operating mechanism is made possible.

29 Claims, 9 Drawing Sheets

SEPARATOR FOR MECHANICALLY SEPARATING AN ACTUATOR AND AN OPERATOR

BACKGROUND

The invention relates to a separator for mechanically separating an actuator and an operating mechanism which is adapted to be displaced by said actuator. Examples of actuators and operating mechanisms of the type in question have been described e.g. in DE 202 13 391, WO 2008/125136 of the present applicant. The actuator in question is normally driven electrically by one or a plurality of motors and displaces an operating element of the operating mechanism. Such an operating mechanism is e.g. a choke, a valve, a BOP (blow-out preventer) or the like. Such operating mechanisms are used in the field of oil or natural gas drilling/production.

In the case of such known units comprising actuators and operating mechanisms, safety measures have already been taken so as to displace e.g. the operating mechanism to a safe position if the actuator should fail.

All the hitherto known safety measures are, however, comparatively complicated from the structural point of view and must additionally be installed in particular in the operating mechanism or in the actuator.

SUMMARY

It is the object of the present invention to allow the actuator and the operating mechanism to be mechanically separated by a suitable separator in a simple way, without such a separator leading to any structural modifications or enlargements of the actuator and/or the operating mechanism. In addition, the separator according to the present invention should be operable easily, in particular by an external user, and allow predetermined displacement of the operating mechanism.

According to the present invention, the separator is arranged between the actuator and the operating mechanism. This has the effect that structural modifications of the actuator and of the operating mechanism can be dispensed with. The separator according to the present invention comprises a driving mechanism. For example, the driving mechanism can be a clutch with first and second clutch components. The first clutch component is associated with the actuator and the second clutch component is associated with the operating mechanism. By displacing the clutch components from a clutch engagement position to a clutch release position, the driving connection between the actuator and the operating mechanism is separated. This displacement to the release position simultaneously enables the operating mechanism to assume a safe position, which, especially in the case of oil or natural gas production, is necessary for avoiding e.g. an unintentional escape of oil or gas.

In order to be easily able to move the clutch components relative to one another, at least one of the components of the driving mechanism is provided with an application part. In order to be able to displace this application part and, consequently, the component connected thereto, the application part is adapted to be brought into releasable engagement with an external displacement part which is suitable for handling by a user.

It is thus possible to separate the operating mechanism from the actuator and to shift it to a safe position even if the actuator should fail to operate or operate incorrectly.

In order to allow easy engagement of the application part and of the displacement part, the application part may be pin-shaped.

According to another embodiment, the application part can be an annular ring, which projects, in particular in the radial direction, at least at certain locations.

In order to allow an adequate engagement with the application part in both cases, the displacement part may be provided with at least one reception slot for the application part. This reception slot has inserted therein e.g. the pin-shaped application part, which can then be displaced in an adequate manner by moving the displacement part so as to shift e.g. the separator to a release position.

In order to allow the application part to be inserted into the displacement part more easily, the reception slot can in this respect be provided with an opening which widens towards the application part. The reception slot and the application part can thus be associated more easily.

This will be of advantage in particular for an external user, which may also be an ROV (Remote Operated Vehicle) or the like.

When a pin-shaped application part and an application ring are compared with one another, it turns out that they differ insofar as a pin-shaped application part should normally be arranged on the respective driving mechanism component such that it is secured against rotation relative thereto, so as to allow a reliable engagement with the displacement part. Such an engagement that prevents relative rotation will normally not be necessary in the case of an application ring.

Furthermore, it should be pointed out that neither a hydraulic nor a electric supply is necessary according to the present invention, since the separator carries out a mechanical separation by means of the external user.

According to another embodiment, the displacement part can be a rotatable displacement cylinder. This displacement cylinder includes it its circumferential surface the reception slot, which may e.g. be helical in shape. By rotating the displacement cylinder in an adequate manner, also the application part will be displaced and, consequently, the mechanical separation will be carried out by means of the separator. The displacement cylinder can in this respect be arranged outside of and in closely spaced relationship with the application part so that an adequate engagement and cooperation of these two components is possible.

It is also imaginable that the displacement cylinder surrounds the application part, so that the latter engages, from the interior of the displacement cylinder, a complementary groove as a reception slot.

Also in the case of these two embodiments, the respective reception slot can be adapted to be brought into engagement with the application part via an extended opening.

When the displacement part has been used as intended, it can be removed from the external user and e.g. be carried along by said external user.

In order to allow the respective driving mechanism components to be produced easily and such that a reliable engagement can be established, if a clutch is used, the first and second clutch components can be implemented as clutch sleeves which are adapted to be inserted into one another. When the respective clutch sleeves have been inserted into one another, e.g. the clutch engagement position is realized, whereas the clutch release position is realized when the clutch sleeves are separated at least partially or drawn apart partially.

In order to allow each of the clutch sleeves to be associated with and releasably connected to the actuator and the operating mechanism, respectively, each clutch sleeve may comprise a sleeve bottom and a sleeve reception opening located opposite to said sleeve bottom. The sleeve bottom serves e.g. for fastening the respective clutch sleeve to a part of the actuator or of the operating mechanism. The respective parts of the actuator and of the operating mechanism are, when no separator is provided, directly connected to one another so as to allow through this connection a displacement of the operating mechanism through the actuator.

The sleeve reception openings of the clutch sleeves serve to insert the respective clutch sleeves into one another until the clutch engagement position has been reached.

In order to simplify the connection of the two clutch sleeves in the clutch engagement position as well as the connection to the actuator or the operating mechanism, the separator may additionally comprise a clutch push rod. This clutch push rod is arranged in the interior of the clutch sleeves and connected to e.g. a respective actuator element of the actuator.

In order to easily realize the engagement position and also the release position, one of said clutch sleeves may be provided with a conically narrowing portion, said conically narrowing portion being in contact with an edge portion of the other clutch sleeve in the engagement position. Due to this contact, the two clutch sleeves are coupled to one another so that a rotary movement of the actuator can be transmitted to the operating mechanism via the coupled clutch components. The release position is in this respect established by eliminating the contact between the edge portion and the conically narrowing portion.

In order to support in this respect the contact between the edge portion and the conically narrowing portion, the edge portion may have, on the inner side thereof, a projection which protrudes radially inwards and which is adapted to be brought into supporting engagement with a complementary circumferential groove of the clutch push rod. This engagement is established in particular in the engagement position.

It is possible to move only one driving mechanism component and to realize thus the engagement position or the release position. Furthermore, it is possible that respective application parts protrude from each component, so that each component can be displaced separately by means of a respective displacement part. In this respect, it should be taken into account that it is also possible to establish the engagement position by only displacing one component by an application part, whereas the displacement of the other application part on the other component has the effect that e.g. the operating mechanism will be displaced to a specific position.

By adequately arranging and implementing the application part and the displacement part, further variations of displacing each component as well as of displacing the components relative to one another are possible.

It is, for example, possible to establish the release position by means of an application part of a component, whereas, depending on the type of operating mechanism, the operating mechanism can be opened or closed or adjusted in some other way, also variably, by means of displacing the other application part of the other component.

A simple embodiment of such an application part is an annular flange which projects radially outwards, at least at certain locations. This annular flange is arranged on the component or, if the embodiment is a clutch, the clutch sleeve.

It has already been pointed out that the separator can be arranged between the actuator and the operating mechanism. In order to easily allow this mode of arrangement also in the case of different types of operating mechanisms and actuators on the basis of a small number of structural modifications, the separator may be configured in particular as a retrofittable module. When no separator is provided, the actuator and the associated operating mechanism are in direct contact with one another so as to interconnect the respective elements.

In the area of this connection, the separator is then arranged in the form of a module, so that the connection between the actuator and the operating mechanism can be separated externally and mechanically. In this respect, it may suffice when, depending on the respective operating mechanism used, e.g. only the displacement part is configured such that it allows, on the basis of a variable structural design of the respective reception slot or of the displacement portion, cf. the embodiments following hereinbelow, a displacement of the operating mechanism to a safe starting position.

This means that respective different displacement parts can be used for each of the choke, valve, BOP or the like.

In view of the fact that, in the field of maritime oil or natural gas production, it may be comparatively difficult to bring the displacement part and the application part into suitable engagement with one another, the separator may comprise a guide unit for the displacement part. Normally, such a guide unit will work such that will guide the displacement part already before the latter comes into contact with the application part and guide said displacement part accurately to the application part in a reproducible manner.

The use of such a guide unit provides a higher mechanical load capacity, which may otherwise perhaps not be given to a sufficient extent during a first direct contact between the application part and the displacement part.

It is imaginable that the guide unit guides the displacement part directly to the application part. An indirect guidance is, however, imaginable as well, by providing the displacement part with at least one guide element for engagement with the guide unit. This has the effect that the guidance and the influence which the displacement part has on the application part are separated from one another.

In order to realize a comparatively simple guide unit, the latter may comprise one or a plurality of generally C-shaped, slotted guide sleeves for guiding generally rod-shaped guide elements.

The C-shape of the guide sleeves will be of advantage in particular in cases where e.g. two guide elements have arranged between them a displacement plate as a displacement part. This displacement plate extends through the slots in the C-shaped guide sleeves and is provided with at least one displacement portion projecting in the direction of the application part. Guided by the guide elements in the guide sleeves, this displacement portion comes into contact with the application part and allows an adequate displacement of said application part.

In order to allow in the case of a simple linear movement of the displacement portion as a displacement part an adequate displacement of the application part transversely to this linear direction, the displacement portion can be delimited by at least one displacement bevel. The displacement portion comes into contact with the application part via its displacement bevel and, in response to a further linear displacement of the displacement portion, the displacement bevel pushes the application part in an adequate direction.

In order to improve guidance in this respect and in order to make it mechanically more stable, guide elements can be releasably fastened to upper and lower narrow sides of the displacement plate. Accordingly, the guide unit is provided with associated guide sleeves.

In order to simplify the handling of the displacement part by an external user, the displacement part may be provided with a handling end portion, the displacement plate being laterally fastened to said handling end portion in a releasable manner. It is also possible to fasten displacement plates on both sides of the handling end portion. Such a handling end portion is provided with a suitable coupling possibility for an external user, e.g. an ROV or the like.

In order to allow, in combination with sufficient mechanical stability, a certain elasticity of the displacement part, the displacement plate and the handling end portion may be fastened via elastic inserts. Such inserts consist e.g. of an elastic rubber or plastic material and allow a linear guidance or alignment of the guide elements, although a certain flexibility of the guide elements is still given.

Depending on the respective embodiment, the displacement plate may comprise various displacement portions with respective displacement bevels for each clutch component and its application part, or the displacement plate may comprise a displacement portion with two opposed displacement bevels, the first of said displacement bevels cooperating with the application part of the first clutch component and the second one cooperating with the application part of the second clutch component.

In both cases each of the clutch components can be displaced separately and in a variable manner, depending on the structural design of the displacement bevels, by displacing only one displacement part.

As regards the displacement bevels, it should additionally be pointed out that they may have different inclination angles, which, when coming into contact with the application part, influence the displacement of the latter.

Due to adequate guidance and by means of these bevels, the driving mechanism components are positioned such the respective operating element of the operating mechanism will be displaced to a defined position.

In order to support the contact between the application part and the displacement bevel, at least one component can be acted upon by a spring, in particular in the direction of the engagement position.

A mechanically stable and reliable system can be realized by arranging the displacement plates in pairs side by side with respective guide elements. These juxtaposed displacement plates are plates of a similar type, but it is also imaginable that one displacement plate displaces the first component and the other displacement plate displaces the second component.

In order to simplify the cooperation of guide sleeves and guide elements, the guide unit or the respective guide sleeve may be provided with a widening reception opening in the direction of the guide element.

The respective displacement plates may preferably also be produced by cutting them out of a plate-shaped steel material, and such cutting may be executed by means of laser, plasma or water jet cutting. In order to avoid marine growth on the respective guide sleeves, in particular when these sleeves are used for maritime purposes, it is additionally possible to insert polyurethane rods or the like into the guide sleeves, when the latter are not in use.

DRAWINGS

In the following advantageous embodiments of the present invention will be explained in more detail on the basis of the enclosed figures of the drawing, in which.

DETAILED DESCRIPTION

FIGS. 1 to 6 show schematic diagrams of different embodiments of a separator comprising an application part 6 and a displacement part 7.

Figure 1:
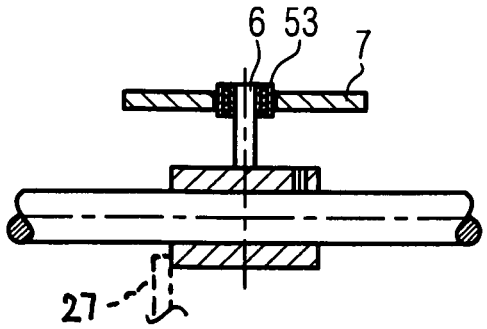
FIG. 1 shows a schematic representation of a separator according to a first embodiment of the invention in a sectional side view.
Figure 2:
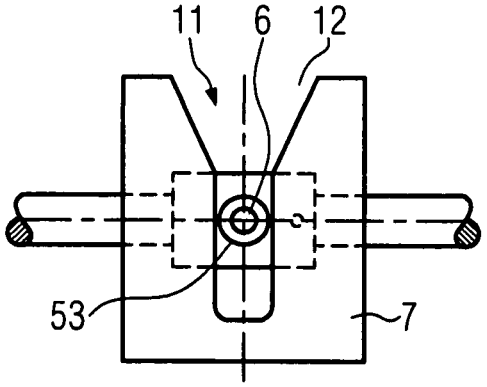
FIG. 2 shows a top view of the embodiment according to FIG. 1.

FIGS. 1 and 2 show a first embodiment of a separator in a longitudinal section and in a top view. In the representations according to FIGS. 1 to 6 the actuator and the operating mechanism are not shown, nor are respective parts used for coupling and decoupling shown in these figures.

What is, however, shown is the principle of the present invention.

In particular, an application part 6 is shown, which has essentially the shape of a pin that projects radially outwards from a sleeve. The sleeve is secured to a shaft such that it is secured against rotation relative thereto, said shaft extending between the non-depicted actuator and the operating mechanism. A displacement part 7 comprising a reception slot 11 is adapted to be moved into contact with the application part 6 from outside and externally. The reception slot 11 is open towards the application part and is provided with a reception opening 12 that widens in this direction. The displacement part 7 can be moved by a user, such a user being e.g. an ROV (Remote Operated Vehicle).

When the application part 6 has been arranged in the reception slot 11, cf. FIG. 2, the displacement part can be displaced to the left or to the right in FIG. 2, i.e. in the longitudinal direction of the shaft, whereby the application part 6 will be displaced in this direction. This will cause coupling or decoupling within the separator so that the actuator and the operating mechanism are separated from or connected to one another.

Figure 3:
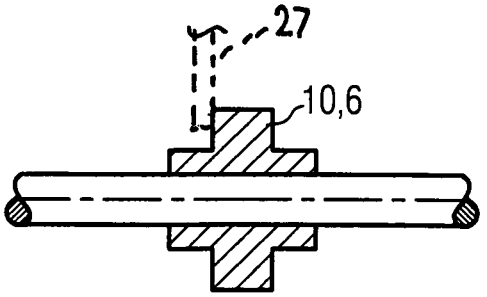
FIG. 3 shows, in analogy with FIG. 1, a representation of a second embodiment.
Figure 4:
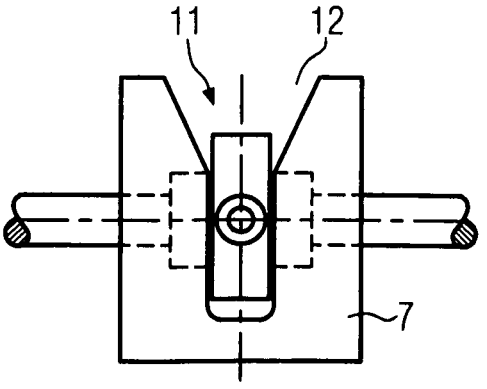
FIG. 4 shows a top view of the second embodiment according to FIG. 3 with a displacement part.

FIGS. 3 and 4 show a second embodiment, which differs from the above embodiment essentially with respect to the shape of the application part 6. Instead of a pin-shaped application part according to FIGS. 1 and 2, an application ring 10 is used in FIGS. 3 and 4, said application ring 10 extending around the respective shaft and projecting radially outwards therefrom. In this case, it is not necessary to connect the application ring or the respective sleeve and the shaft such that they are secured against rotation relative to one another.

Figure 5:
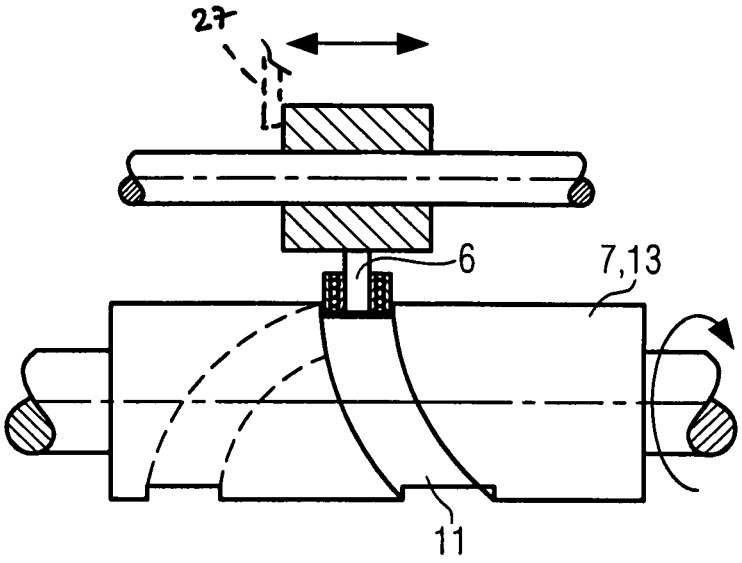
FIG. 5 shows, in analogy with FIG. 1, a view of a third embodiment.
Figure 6:
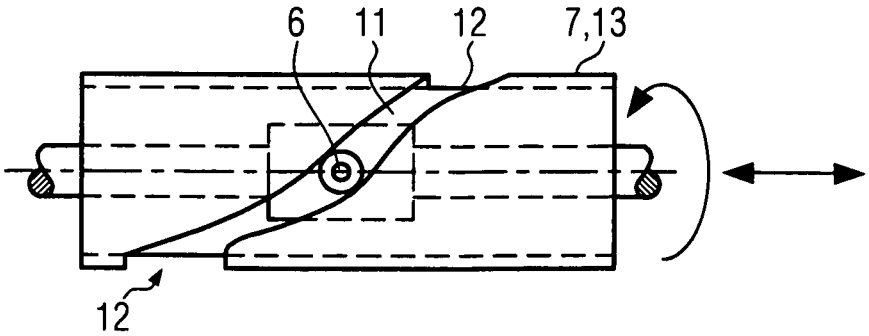
FIG. 6 shows, in analogy with FIG. 1, a representation of a fourth embodiment.

Additional embodiments are shown in FIGS. 5 and 6. In these embodiments, the displacement part is not plate-shaped, as has been the case with the preceding embodiments, but cylindrical, and is thus configured as a displacement cylinder 13. This displacement cylinder 13 is rotatable about an axis so that, when the rotation takes place, the pin-shaped application part 6 moves along the helical reception slot 11 and is thus displaced in the longitudinal direction of the shaft. The reception slot 11 is arranged in an outer surface of the displacement cylinder 13 and may, if necessary, also extend up to and into the interior of the displacement cylinder 13.

Such a displacement cylinder 13 with a continuous reception slot 11 is shown in the fourth embodiment according to FIG. 6. Also in this case, the displacement cylinder 13 is rotated for displacing the application part 6 in the longitudinal direction of the associated shaft. The displacement cylinder 13 surrounds the shaft as well as the application part 6, which is inserted into the respective reception slot 11 from inside. At least in the embodiment according to FIG. 6, the reception slot is also provided with respective reception openings 12 at the ends of the reception slot.

In the case of all the embodiments according to FIGS. 1 to 6, a connection between the actuator and the operating mechanism is separated or influenced mechanically so that the driving connection between these two elements will be interrupted.

Figure 15:
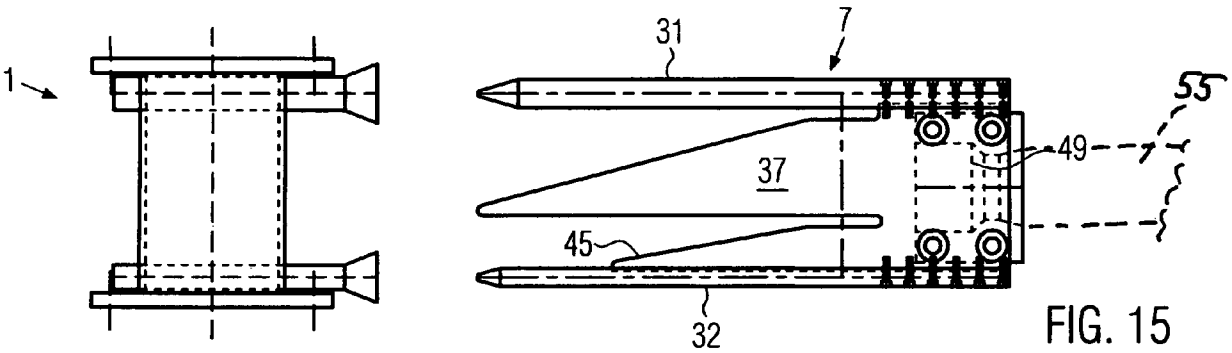
FIGS. 15 to 17 show various relative positions of the displacement part and the module housing with part of ROV in FIG. 15.

For actuating the respective displacement part 7, it is not necessary to provide any electric or hydraulic supply, but the displacement part 7 is operated mechanically, e.g. by an ROV 55, see FIG. 15.

In the above embodiments and also in the embodiments following hereinbelow, it is not necessary to actuate the actuator in its interior or to eliminate the self-holding function in an actuator of the self-locking function type. Instead, a direct separation of the driving connection between the actuator and the operating mechanism is executed and possibly also a displacement of the operating mechanism to a safe starting position. Depending on the operating mechanism used, the safe starting positions may differ from one another. In the case of a valve or a choke, the aimed-at starting position may be a fully closed or a fully open position, or an arbitrary intermediate position.

Further embodiments are shown in the figures following hereinbelow.

Figure 7:
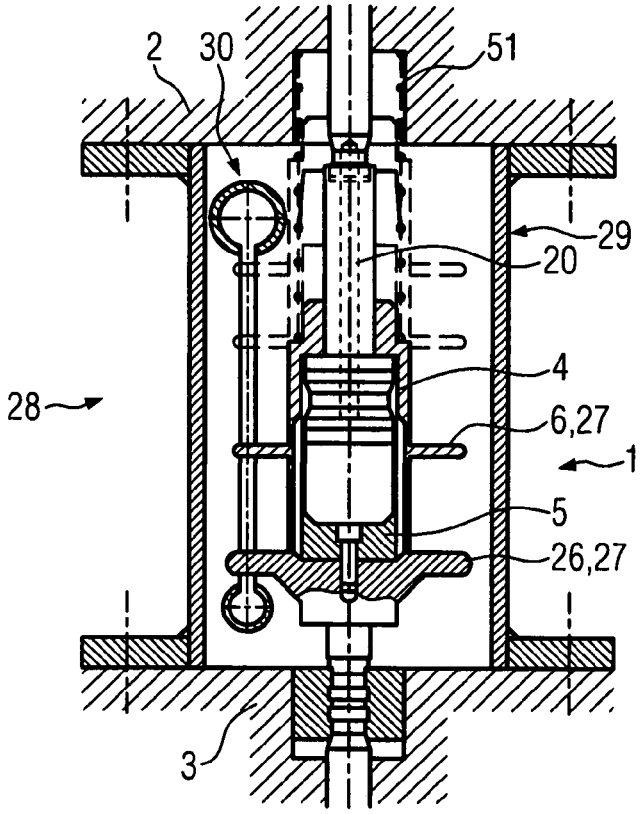
FIG. 7 shows a representation of a fifth embodiment according to the present invention in a longitudinal section.

FIG. 7 shows a vertical section through a fifth embodiment of a separator of the type in question. This separator is inserted between the actuator 2 and the operating mechanism 3 in the form of a module 28. The movement connection between the actuator and the operating mechanism extends through the separator 1, cf. in this respect also the assignment of a first component 4 to the actuator 2 and of a second component 5 to the operating mechanism 3. In this embodiment the separator driving mechanism is a clutch and both the first component 4 and the second component 5 are clutch components. The second clutch component 5 is connected to a respective operating element of the operating mechanism 3, a movement connection existing between the first and second clutch components 4, 5 only in the clutch engagement position 8, cf. in this respect also FIG. 11 to FIG. 14. In FIG. 7, the clutch components are arranged in the clutch engagement position 8. In the interior of the two clutch components, a clutch push rod 20 is additionally provided. One end of this clutch push rod 20 is releasably connected to a respective operating element of the actuator 2 and serves to transmit, in the clutch engagement position, a rotary motion to the second clutch component 5 and, via said second clutch component 5, to the respective operating element of the operating mechanism 3.

The clutch components 4 and 5 and the clutch push rod 20 are arranged within a module housing 29 of the module 28. This module housing 29 is open in the direction of the displacement part 7, cf. in this respect also FIGS. 15 to 17, and, perpendicularly to this direction, it is closed by approximately C-shaped housing walls. These housing walls are releasably connected to the actuator and the operating mechanism, respectively.

On one side of the module housing 29, a guide unit 30 is provided. This guide unit 30 comprises two guide sleeves 35 and 36, cf. also FIG. 8, which are arranged one above the other in spaced relationship with one another. The guide sleeves 35 and 36 have different diameters, said diameters being adapted to the respective diameters of associated guide elements 31, 32, cf. FIGS. 15 to 17. The displacement part 7 and the application part 6 are thus associated with one another in an oriented manner.

Figure 8:
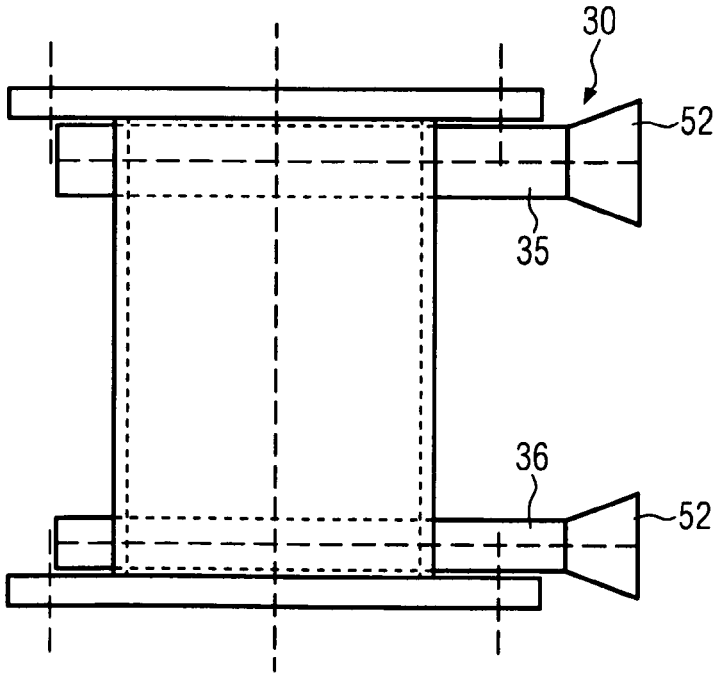
FIG. 8 shows a side view of the embodiment according to FIG. 7.

In the embodiment according to FIGS. 7 and 8, two application parts are provided, one application part 6 having the shape of a radially outwardly projecting annular flange 27 protruding from the outer surface of the first clutch component 4 and, analogously thereto, an application part 26, which also has the shape of an annular flange 27, protrudes from the second clutch component 5. The second clutch component 5 comprises in this case a second clutch sleeve 15 and a plate-shaped connection part provided with the respective application part 26.

In FIG. 7, various positions of the application part 6 of the first clutch component 4 are shown. In the position of the application part 6 represented by the solid line, the clutch engagement position 8 is realized, whereas in the additional positions of the application part 6, which are indicated by broken lines, respective clutch release positions 9 are realized, cf. also FIGS. 11 to 14. At least the first clutch component 4 has pressure applied thereto by a spring element 51 in the direction of the second clutch component 5.

Figure 13:
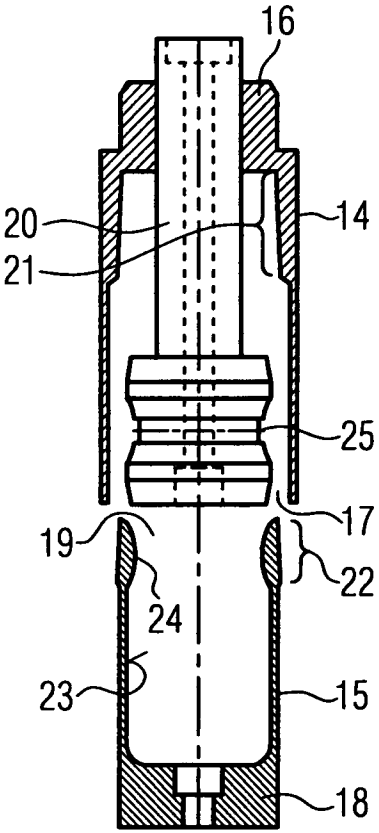
Figure 11:
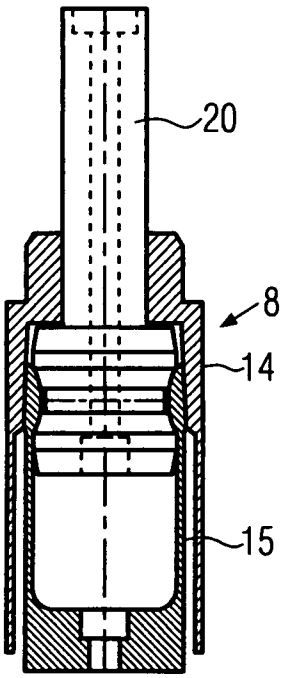

At the respective clutch engagement position 8, the clutch components are inserted into one another to such an extent that they are in rotary frictional engagement with one another due to the fact that a conical portion 21, cf. also FIG. 13, cooperates with an edge portion 22 as well as due to the fact that this edge portion 22 engages a circumferential groove 25 of the clutch push rod 20, cf. also FIG. 11.

In FIG. 8 it can additionally be seen that the respective guide sleeves 35 and 36 are provided with reception openings 52 at one end thereof, said reception openings 52 widening in the direction of the displacement part.

Figure 10:
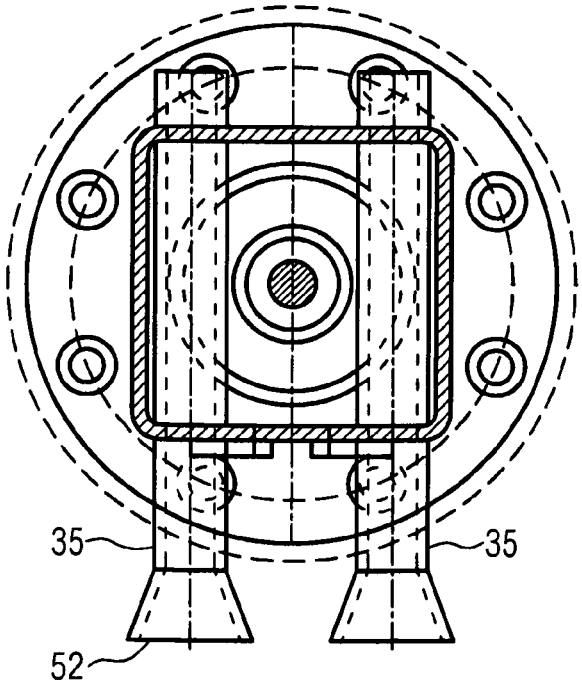
FIG. 10 shows a cross-sectional view of the embodiment according to FIG. 9.

The guide sleeves 35 and 36 are releasably secured to the module housing 29, cf. also FIG. 10.

Figure 9:
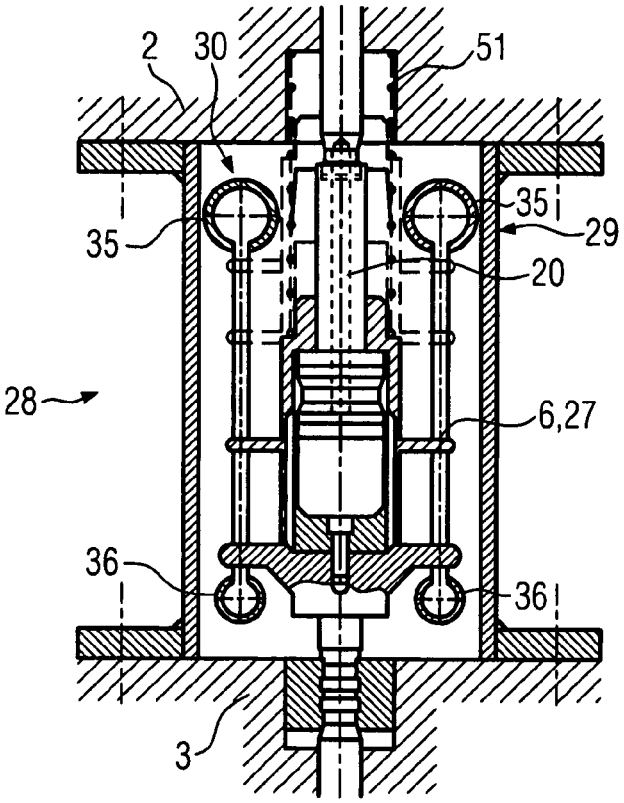
FIG. 9 shows, in analogy with FIG. 7, a representation of a sixth embodiment.

The embodiment according to FIGS. 9 and 10 differs from that according to FIGS. 7 and 8 with respect to the dual arrangement of the guide sleeves 35 and 36 on both sides of the clutch components 4 and 5.

As for the rest, the embodiment according to FIGS. 9 and 10 corresponds to that according to FIGS. 7 and 8 as regards function and use. In correspondence with FIGS. 9 and 10, also the associated displacement part 7 is provided with two respective guide elements, cf. the statements made with respect to the figures following hereinbelow.

Figure 14:
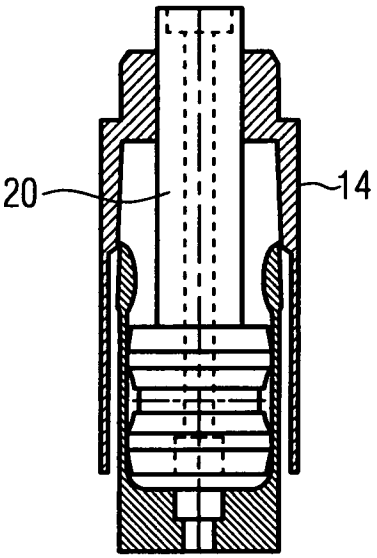
FIGS. 11 to 14 show various relative positions of clutch components according to the present invention.

FIGS. 11 and 14 show various relative positions of the clutch components 4 and 5, which are configured as first and second clutch sleeves 14, 15 in the case of all the respective embodiments.

Such a clutch sleeve 14 or 15 each comprises a sleeve bottom 16, 18 and a sleeve reception opening 17, 19, which is open in the direction of the other clutch component. It is thus possible to insert the two clutch sleeves 14, 15 into one another, cf, e.g. FIG. 11, 12 or 14.

Figure 12:
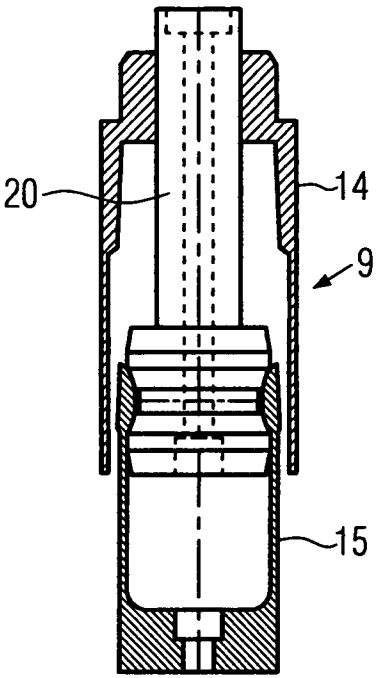

FIG. 11 shows the clutch engagement position 8 and FIG. 12 shows the clutch release position 9. At the clutch release position 9, the clutch push rod 20 is still connected to the second clutch sleeve 15. This connection is established in that an annular projection 24, which is formed on the inner side 23 of the edge portion 22, is in engagement with a complementary circumferential groove 25 provided in a head on an end of the clutch push rod 20.

The respective application parts 6 and displacement parts 7 are not shown in FIGS. 11 to 14 for the sake of simplicity. The displacement of the respective clutch sleeves 14, 15 is, however, based on the cooperation of the application part 6 and the displacement part 7, as will be described in more detail in the following.

In FIG. 13, the clutch sleeves are still decoupled, but the clutch push rod 20 and the second clutch sleeve 15 are now separated as well, i.e. the annular projection 24 and the circumferential groove 25 are no longer in engagement with one another.

At this position of the clutch sleeve, the actuator is at an open position and, due to the further displacement of the second clutch sleeve 15 in the direction of the operating mechanism 3, the latter is at a closed position.

In FIG. 14, the actuator is at a closed position and, due to the displacement of the second clutch sleeve 15 in the opposite direction in comparison with FIG. 13, the operating mechanism is at an open position.

Figure 16:
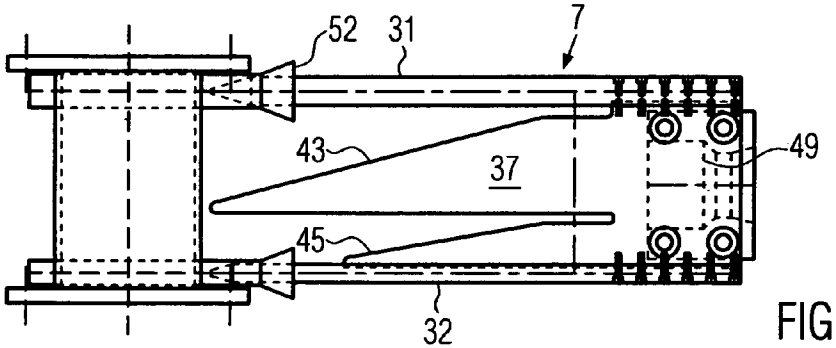
Figure 17:
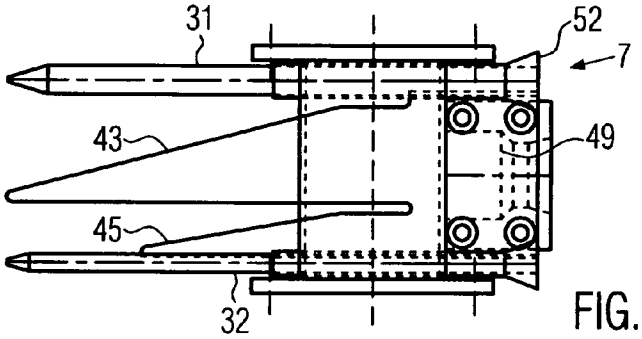

FIGS. 15 to 17 show for the embodiments according to FIGS. 7 to 14 a respective cooperation of the displacement part 7 and the associated application parts 6. In FIG. 15, the respective displacement part 7 is held by means of its handling end portion 49 by the external user, e.g. an ROV, and is then moved in the direction of the separator 1.

The displacement part 7 comprises, in addition to a displacement plate 37, guide elements 31 and 32 provided on the upper and lower ends of said displacement plate 37. These guide elements 31 and 32 are substantially rod-shaped and are used for insertion into guide sleeves 35 and 36 of the guide unit 30, cf. also FIG. 16, The insertion of the guide elements is facilitated by the reception openings 52 of the guide sleeves 35 and 36, said reception openings 52 widening in the direction of the guide elements.

In FIG. 17, the displacement part 7 has been inserted into the separator 1 to the highest possible degree.

During insertion, cf. FIGS. 16 and 17, the displacement plate 37 comes into contact with the respective application part 6. In the embodiment according to FIGS. 15 to 17, the displacement plate 37 is substantially composed of two parts, cf, also FIG. 18, where a first part is defined by a first displacement portion 41 and a second part is defined by a second displacement portion 42. The different displacement portions come into contact with the different application parts 6 and 26, respectively. When the displacement part 7 is inserted still further, cf. FIG. 17, the application parts 6 and 26 slide along respective displacement bevels 43 and 45 of the displacement portions 41 and 42, and due to this movement, cf. FIGS. 11 to 14, the clutch sleeves 14 and 15 are raised or lowered in the direction in question The application part 6, for example, slides along a respective displacement bevel 43, cf. also FIGS. 7 and 9, and the application part 26 slides along the displacement bevel 45. The raising and lowering of the respective application parts and also the moment at which said raising and lowering takes place result from the length of the displacement portions 41, 42 and from the inclination angles of the displacement bevels 43 and 45.

From a comparison between FIGS. 15 to 17 and FIGS. 7 and 9 it can erg. be seen that the application part 6 is raised first, cf. in this respect the final coupling position according to FIG. 12, and that, a short time after said raising of the application part 6, the application part 26 is raised analogously by the displacement bevel 45, cf. e.g. FIG. 14.

Figure 18:
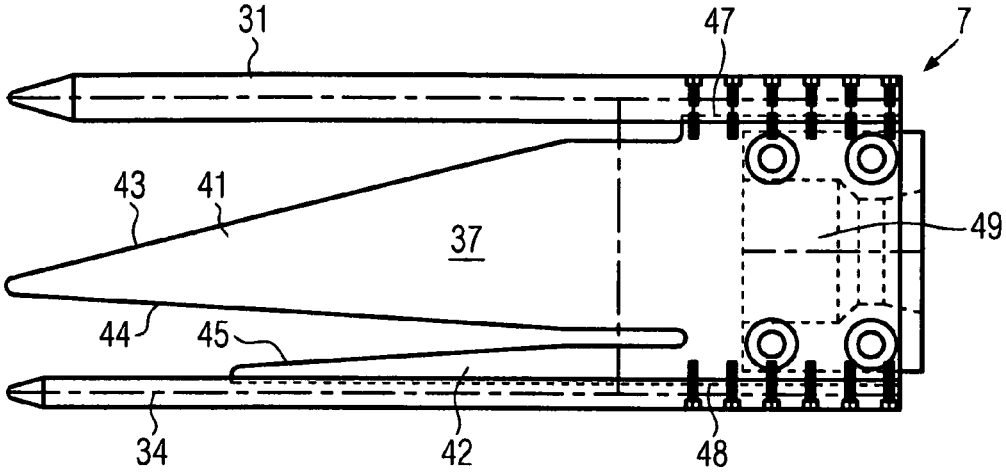
FIG. 18 shows a longitudinal section through an embodiment of a displacement part.
Figure 19:
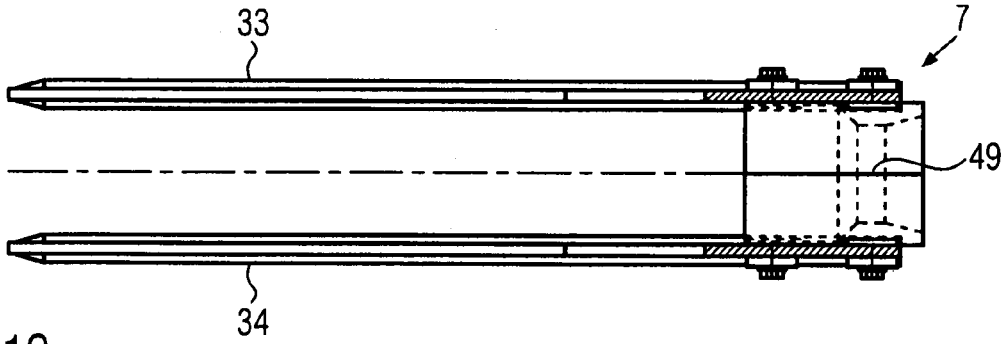
FIG. 19 shows a cross-section through the embodiment according to FIG. 18.
Figure 20:
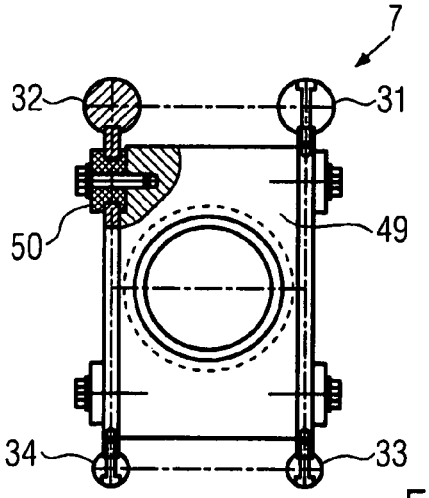
FIG. 20 shows a rear view of the embodiment according to FIG. 18.

The respective guide elements 31 and 32 are releasably secured to upper and lower narrow sides 47, 48 of the displacement plate, cf. also FIGS. 18 to 20. The displacement plate itself is laterally secured to the handling end portion 49 in a releasable manner, cf. FIG. 19.

FIGS. 18 to 20 show the displacement part 7 according to FIGS. 15 to 17 in detail and in an enlarged representation. There is, however, one difference. The displacement bevel 44 on a lower surface of the respective displacement portion 41 is, in the case of the embodiment according to FIGS. 18 and 20, slightly inclined to the bottom right in said figures, whereas in the case of the embodiment according to FIGS. 15 to 17 it extends horizontally without any inclination.

Furthermore, the displacement bevel 45 in the embodiment according to FIGS. 18 to 20 extends slightly less steeply than that in the embodiment according to FIGS. 15 to 17.

It should here be pointed out that a plurality of differently inclined displacement bevels and complementary lengths of the displacement portions are possible and can be selected according to requirements for the actuator and the operating mechanism and the respective separator.

FIG. 18 corresponds to a longitudinal section through the displacement part 7, FIG. 19 corresponds to a cross-section in the longitudinal direction of the displacement part 7 according to FIG. 18, and FIG. 20 is a rear view of the displacement part in question.

The displacement part 7 includes the displacement plate 37 which comprises two displacement portions 41 and 42. The displacement portion 41 has an upper displacement bevel 43 and a lower displacement bevel 44. The displacement bevel 43 comes into contact with the application part 6, and the latter moves, in response to a respective movement of the displacement part 7, along the displacement bevel 43 upwards in FIGS. 7 and 9.

Due to the gently inclined displacement bevel 45 of the displacement portion 42 and the corresponding displacement bevel 44 of the displacement portion 41, the application part 26 according to FIGS. 7 and 9 is moved only slightly towards the operating mechanism, so that, at the position of the displacement part 7 according to FIG. 17, said operating mechanism is essentially still open to approx. 50%. This means that, analogously to FIG. 13, the application part 26 is moved only slightly towards the operating mechanism so that the closed condition is not reached.

Figure 24:
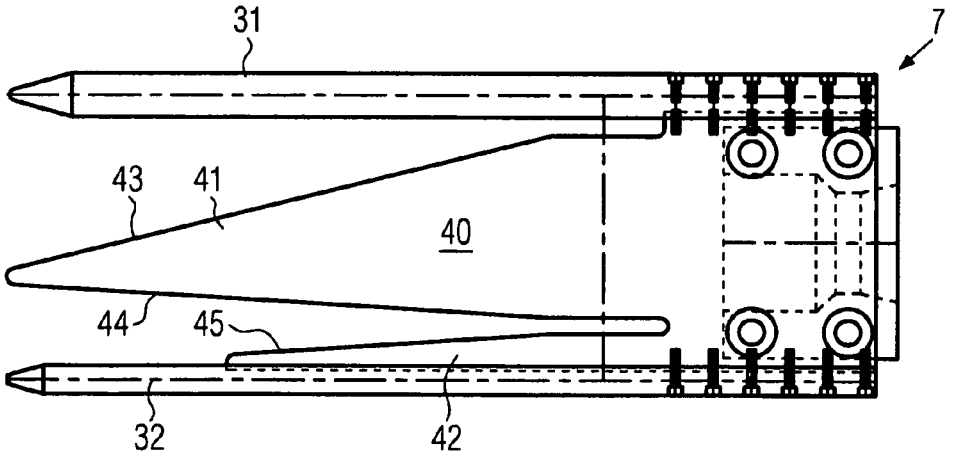
FIG. 24 shows an embodiment of a displacement part with two displacement portions.

The arrangement and the structural design of the displacement portions 41 and 42 correspond substantially to those according to FIG. 24. This applies analogously to the displacement parts 7 according to FIGS. 15 and 25.

In FIG. 18, it can especially be seen that the respective guide elements 31 and 34 are arranged on the upper and lower narrow sides 47 and 48 of the displacement plate 37 in question. In addition, FIGS. 18 and 20 describe a displacement part 7 with two displacement plates, cf. also FIGS. 19 and 20, which are arranged parallel to one another and which are both provided with respective guide elements 31, 32 and 33, 34. The guide elements are essentially circular, cf. also FIG. 20, and are inserted into complementary circular openings of the guide sleeves 35 and 36. The guide elements taper and can thus be assigned more easily to the reception openings 52 of the guide sleeves 35 and 36.

The displacement portions 41 and 42, cf. also FIGS. 19 and 20, are laterally fastened to the handling end portion 49 in a releasable manner. In the respective fastening areas, elastic inserts 50 are arranged. Although these elastic inserts 50 allow the guide elements to extend precisely linearly, a certain elasticity of the guide elements and of the displacement portions relative to the handling end portion 49 is, however, possible.

The handling end portion 49 is provided with a reception means or a coupling for a respective unit of the ROV for handling the displacement part 7.

The structural design of the displacement part 7 is configured analogously in the case of an arrangement of a displacement portion on only one side of the handling end portion 49, cf. e.g. the provision of the guide unit 30 on only one side of the separator according to FIG. 7.

Figure 21:
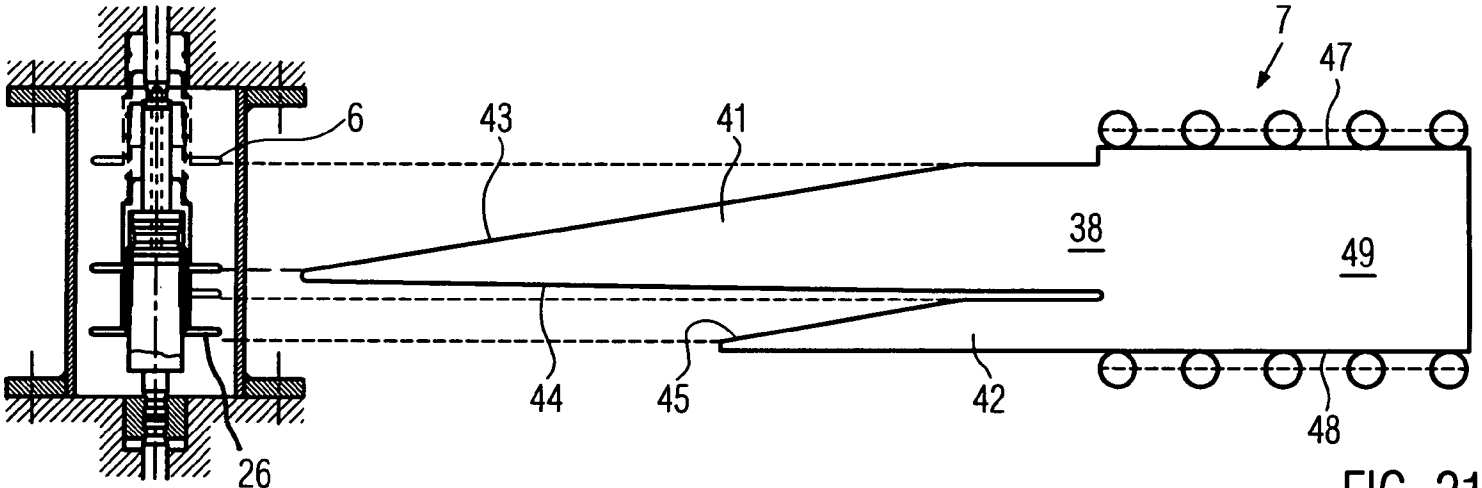
FIG. 21 shows a further embodiment of a displacement part.
Figure 22:
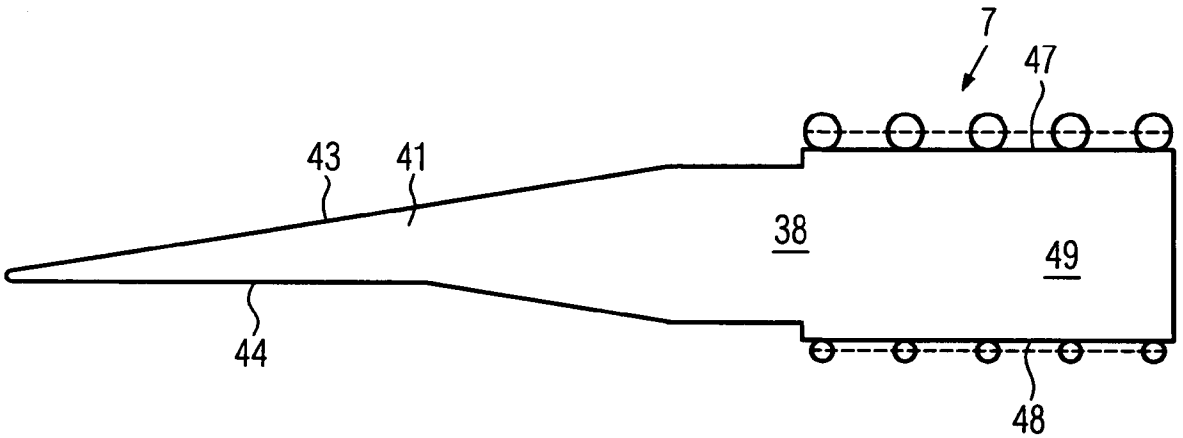
FIG. 22 shows still another embodiment of a displacement part.

FIGS. 21 and 22 show additional embodiments of displacement parts 7. The cooperation of these displacement parts with the application parts takes place analogously to the other embodiments and will here not be described in detail. Also the structural design of the separator is essentially identical, cf. the respective clutch components 4, 5 and application parts 6, 26 associated therewith. In the case of the embodiment according to FIG. 21, a difference exists insofar as the application part 26 projects directly from the second clutch component 5, cf. in this respect the slightly different structural design according to FIG. 7.

Another difference exists with respect to the way in which the displacement part 7 is guided relative to the module housing 29, which does not comprise any guide sleeves in this case. Nor is the displacement part 7 provided with rod-shaped guide elements, said rod-shaped guide elements being replaced by rotatable guide balls on the upper and lower narrow sides 47, 48 of the displacement plate 38 of the displacement part 7. This applies analogously also to the displacement part 7 according to FIG. 22.

In FIG. 21 a few positions of the application part 6 relative to the displacement bevel 43 and of the application part 26 relative to the displacement bevel 45 are indicated by broken lines.

When the displacement part 7 is being inserted, it moves, cf. in this respect again the statements made in connection with FIGS. 15 to 17, from the lower position shown in FIG. 21 up to and into the upper position shown. This applies analogously to the application part 26, which also moves from a lower position into an upper position, said movement taking, however, place with a time shift to the movement of application part 6. This means that the clutch components are decoupled and the second clutch component is raised, cf. e.g. FIG. 14.

The displacement parts 7 of the hitherto described embodiments each had two displacement portions 41 and 42, whereas the displacement part 7 according to FIG. 22, cf. the displacement plate 39, only has one displacement portion 41. This displacement portion 41 has, on its upper and lower narrow sides, the displacement bevels 43 and 44 which respectively come into contact with the two application parts 6 and 26. This has the effect that the application part 6 is raised by the displacement bevel 43, cf. in this respect also FIGS. 11 and 12, whereas the application part 26 and, consequently, the second clutch component 5 are displaced downwards by the displacement bevel 44, cf. in this respect also FIG. 13.

Figure 23:
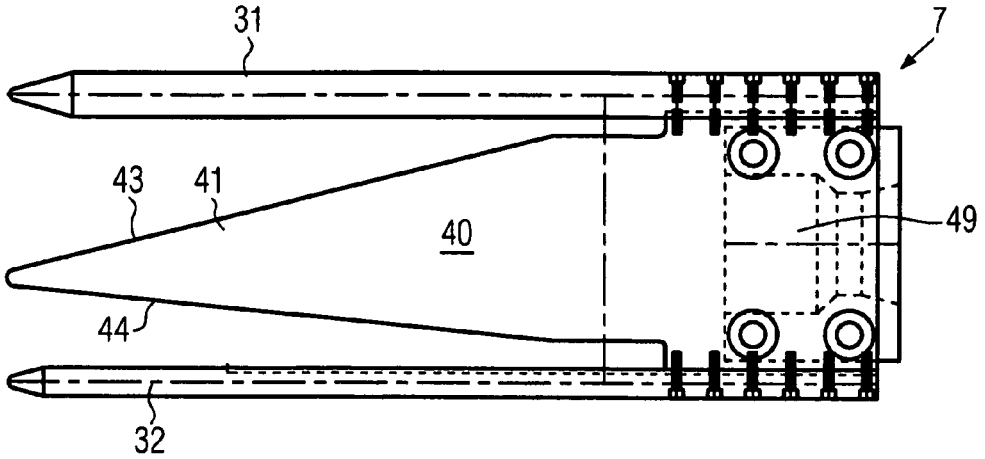
FIG. 23 shows an embodiment of a displacement part with a displacement portion.
Figure 25:
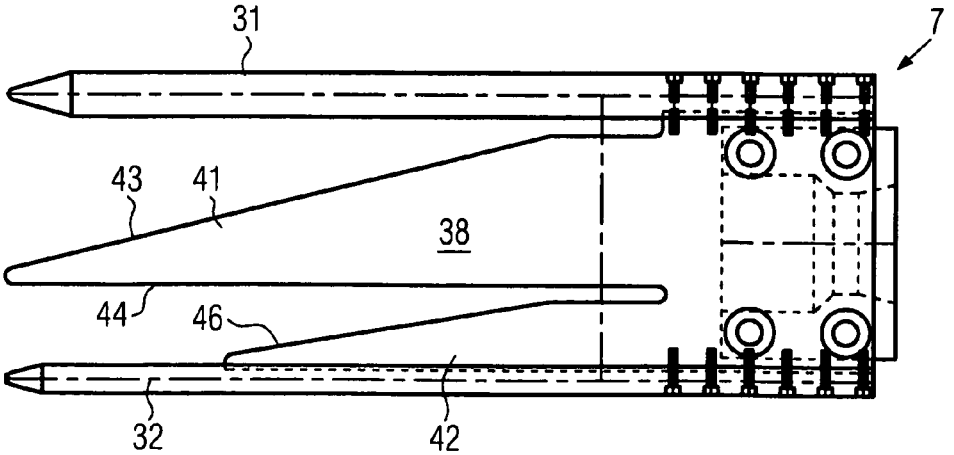
FIG. 25 shows, in analogy with FIG. 24, an embodiment with different displacement bevels of the displacement portions.

FIGS. 23 to 25 show various displacement parts 7 once more. Also the displacement part 7 according to FIG. 23 only has one displacement portion 41 of a displacement plate 40 analogously to FIG. 22. This arrangement essentially results in a displacement of the clutch components according to FIG. 13.

The displacement part 7 according to FIG. 24 comprises two displacement portions 41 and 42, the displacement portion 41 with its displacement bevel 43 raising the first clutch component of the application part 6 and displacing, through of its displacement bevel 44 and the displacement bevel 45 of the displacement portion 42, the second clutch component by means of the application part 26 to a position at which the operating mechanism is open to approx. 50%.

The displacement part 7 according to FIG. 25 leads to an essentially 100% opening of the operating mechanism by raising the second clutch component in an appropriate manner, cf. also FIG. 14.

From the above it can be seen that the separator according to the present invention comprising a displacement part offers a plurality of possibilities of adjusting the actuator and the associated operating mechanism, said adjustment possibilities concerning not only a decoupling of these two elements but also a displacement of an operating element of the operating mechanism by an external mechanical action via a ROV.

In addition, only some of the large number of variations are described in the figures enclosed, additional variations being possible by providing the displacement portions with a suitable shape and length and the displacement bevels with a suitable inclination.

All this is possible on the basis of an only simple linear movement of the respective displacement part by means of the ROV so as to eliminate in certain cases the cooperation of the actuator and of the operating mechanism. An electric or hydraulic supply is not necessary for this separation. In addition, it is not necessary to take any structural measures with respect to the actuator or the operating mechanism, since the respective separator can simply be arranged between these two elements. Suitable standard fastening areas, to which the separator according to the present invention is adapted, can be used. This also applies to the mode of fastening by means of screws or the like.

Likewise, it is possible that respective displacement parts can easily be retracted by the ROV so that the operating mechanism can then be repositioned by means of the actuator.

The invention claimed is:

1. A separator for mechanically separating an actuator and an operating mechanism, comprising:

a first component associated with the actuator;

a second component associated with the operating mechanism;

an application part connected to the first or second component;

a displacement part adapted to be handled by a user and including a reception slot for the application part;

the first and second components being displaceable relative to one another, by means of the application part, between an engagement position and a release position; and the application part being adapted to be brought into releasable engagement with the displacement part.

2. A separator according to claim 1, wherein the application part is pin-shaped.

3. A separator according to claim 1, wherein the application part includes a substantially annular application ring, which projects, in particular in the radial direction, at least at certain locations.

4. A separator according to claim 1, wherein the reception slot includes a reception opening which widens towards the application part.

5. A separator according to claim 1, wherein the displacement part is operable by a remote operated vehicle (ROV) or the like.

6. A separator according to claim 1, wherein the displacement part includes a rotatable displacement cylinder.

7. A separator according to claim 6, wherein the displacement cylinder surrounds the application part.

8. A separator according to claim 1, further including a push rod adapted to be connected to the actuator.

9. A separator according to claim 1, wherein the first and second components include clutch sleeves are adapted to be inserted into one another.

10. A separator according to claim 9, wherein each clutch sleeve includes a sleeve bottom and a sleeve reception opening located opposite to said sleeve bottom.

11. A separator according to claim 9, wherein one of the clutch sleeves includes a conically narrowing portion, said conically narrowing portion being in contact with an edge portion of the other clutch sleeve in the engagement position.

12. A separator according to claim 11, wherein the edge portion includes, on an inner side thereof, a projection protruding radially inwards and adapted to be brought into engagement with a complementary circumferential groove of the push rod.

13. A separator according to claim 1, wherein an application part protrudes from each of the first and second components.

14. A separator according to claim 1, wherein the application part includes an annular flange projecting radially outwards.

15. A separator according to claim 1, wherein the separator includes a module retrofittable to the actuator and operating mechanism.

16. A separator according to claim 1, wherein the separator includes a module housing that includes a passage at least in the direction of the displacement part.

17. A separator according to claim 1, further including a guide unit for the displacement part.

18. A separator according to claim 17, wherein the displacement part includes a guide element for engagement with the guide unit.

19. A separator according to claim 17, wherein the guide unit includes guide sleeves for guiding rod-shaped guide elements.

20. A separator according to claim 1, wherein guide elements for engagement with the guide unit include a displacement plate arranged between them, each displacement plate including a displacement portion projecting in the direction of the application part.

21. A separator according to claim 20, wherein the guide elements are releasably fastened to upper and/or lower narrow sides of each displacement plate.

22. A separator according to claim 20, wherein the displacement part includes a handling end portion, and each displacement plate is fastened to the handling end portion in a releasable manner.

23. A separator according to claim 22, wherein each displacement plate and the handling end portions are fastened via elastic inserts.

24. A separator according to claim 20, wherein the displacement portions are delimited by a displacement bevel.

25. A separator according to claim 24, further including an application part associated with each of the first and second components, and wherein each displacement plate includes displacement portions and respective displacement bevels for each of the first and second components and associated application parts.

26. A separator according to claim 25, wherein the displacement portions each include two opposed first and second displacement bevels, the first displacement bevel cooperating with the application part of the first component and the second displacement bevel cooperating with the application part of the second component.

27. A separator according to claim 20, further including multiple displacement plates arranged in pairs side by side with respective guide elements.

28. A separator according to claim 20, wherein, in the direction of each guide element, the guide unit includes a widening reception opening.

29. A separator according to claim 1, wherein at least one of the first and second components is acted upon by a spring, in particular in the direction of the engagement position.

* * * * *